US005133263A

United States Patent [19]

Theurer

[11] Patent Number: 5,133,263

[45] Date of Patent: Jul. 28, 1992

[54] BALLAST TAMPING ASSEMBLY

[75] Inventor: Josef Theurer, Vienna, Austria

[73] Assignee: Franz Plasser Bahnbaumaschinen-Industriegesellschaft m.b.H., Vienna, Austria

[21] Appl. No.: 685,876

[22] Filed: Apr. 15, 1991

[30] Foreign Application Priority Data

Apr. 20, 1990 [AT] Austria ..... 930/90

[51] Int. Cl.[5] ..... E01B 27/02

[52] U.S. Cl. ..... 104/12

[58] Field of Search ..... 104/12, 10, 2

[56] References Cited

U.S. PATENT DOCUMENTS

| | | | |
|---|---|---|---|
| 3,357,366 | 12/1967 | Plasser et al. | 104/12 |
| 3,372,651 | 3/1968 | Plasser et al. | 104/12 |
| 3,429,276 | 2/1969 | Plasser et al. | 104/12 |
| 3,494,297 | 2/1970 | Plasser et al. | 104/12 |
| 3,608,498 | 9/1971 | Plasser et al. | 104/12 |
| 4,090,451 | 5/1978 | Theurer | 104/12 |
| 4,094,250 | 6/1978 | Theurer | 104/12 |
| 4,130,063 | 12/1978 | Theurer et al. | 104/12 |
| 4,628,822 | 12/1986 | Theurer | 104/12 |
| 5,048,425 | 9/1991 | Theurer | 104/12 |

FOREIGN PATENT DOCUMENTS

| | | | |
|---|---|---|---|
| 337753 | 11/1976 | Austria . | |
| 385797 | 10/1987 | Austria . | |
| 0195882 | 10/1986 | European Pat. Off. | 104/12 |
| 1918588 | 1/1970 | Fed. Rep. of Germany | 104/12 |
| 2426841 | 1/1975 | Fed. Rep. of Germany | 104/12 |
| 0045011 | 4/1979 | Japan | 104/12 |
| 569836 | 10/1975 | Switzerland . | |
| 2092648 | 8/1982 | United Kingdom | 104/12 |

*Primary Examiner*—Robert J. Oberleitner
*Assistant Examiner*—Mark T. Le
*Attorney, Agent, or Firm*—Collard & Roe

[57] ABSTRACT

An assembly for tamping ballast underneath three successive ties comprises a vertically adjustable tool carrier, three pairs of vibratory ballast tamping tools mounted on the tool carrier and arranged successively in the longitudinal direction of the track, each tamping tool including a tamping pick and the pairs of tamping tools being so spaced from each other in this direction that two adjacent proximal tools of the three pairs may be immersed in the ballast in each crib defined between the three successive ties and a respective distal tool may be immersed in the ballast in a respective crib adjacent each of said cribs, two crank shafts mounted on the tool carrier and spaced from each other in this direction, and reciprocating drives mounted on the tool carrier and connected to the tamping tools for reciprocating the tools in this direction, the reciprocating drives connected to the two proximal tools in each crib and the distal tool adjacent thereto connecting each crank shaft to the two proximal tools and the distal tool.

10 Claims, 2 Drawing Sheets

BALLAST TAMPING ASSEMBLY

BACKGROUND OF THE INVENTION

1. Field of the Invention

The present invention relates to an assembly for tamping ballast underneath three successive ties of a longitudinally extending track including two rails supported on a plurality of successive ties resting on the ballast, the three successive ties defining cribs therebetween, the ballast tamping assembly comprising a vertically adjustable tool carrier means, three pairs of vibratory ballast tamping tools, i.e. six tamping tools, mounted on the tool carrier means and arranged successively in the longitudinal direction of the track, each tamping tool including a tamping pick and the pairs of tamping tools being so spaced from each other in this direction that two adjacent proximal tools of the three pairs may be immersed in the ballast in each crib defined between the three successive ties and a respective distal tool may be immersed in the ballast in a respective crib adjacent each crib defined between the three successive ties. The tamping tools are connected to a crank shaft by reciprocating drives for reciprocating the tools in this direction.

2. Description of the Prior Art

A ballast tamping assembly of this type has been disclosed in Austrian patent No. 385,797, of Oct. 15, 1987. In an embodiment of the assembly illustrated in FIG. 9 of the patent, a crank shaft is mounted centrally on a tamping tool carrier and the tamping tools are connected to the crank shaft by a pair of crank arms and the reciprocating drives. Each crank arm is constituted by a bell crank lever and has a bearing ring linking the bell crank lever to the crank shaft as well as a second pivot connecting the tamping tools of a respective one of the successively arranged pairs of tamping tools to the crank arm. A third link couples each crank arm to a pivot pin mounted of the tamping tool carrier. This structure has the disadvantage that it transmits a vibratory force from the crank arm to the reciprocating drives in a complex manner and the lever arrangement is susceptible to malfunctioning.

Austrian patent No. 337,753, of Nov. 15, 1976, also discloses a ballast tamping assembly for simultaneously tamping three successive ties, and the six tamping tools are also connected to a centrally arranged crank shaft. To reciprocate the tamping tools for tamping the ballast underneath the ties, the tamping tools are pivoted to the tamping tool carrier between their ends and the pivots are horizontally displaceable in the longitudinal direction of the track. Reciprocating drives are connected to the tamping tool pivots for horizontally displacing the pivots and the upper ends of the tamping tools are connected to the crank shaft by crank arms. Because of the relatively large distance of the two distal tamping tools from the central crank shaft, the two crank arms connecting the distal tools to the crank shaft are rather long and must be quite strong.

U.S. Pat. No. 3,494,297, dated Feb. 10, 1970, discloses a ballast tamping machine comprised of two machine frames linked to each other, each machine frame carrying a ballast tamping assembly capable of simultaneously tamping two successive ties and the two assemblies being so spaced from each other in the longitudinal direction of the track that three successive ties may be tamped at the same time.

A ballast tamping assembly somewhat similar to that of Austrian patent No. 337,753 has been disclosed in Swiss patent No. 569,836, granted Oct. 15, 1974, but the assembly comprises two independent tamping tool carriers arranged successively in the longitudinal direction of the track and each carrying two adjacent proximal tamping tools and a distal tamping tool connected to a crank shaft centrally mounted on the tamping tool carrier.

U.S. Pat. No. 3,372,651, dated Mar. 12, 1968, discloses a ballast tamping assembly for simultaneously tamping two successive ties, with two successively arranged pairs of tamping tools reciprocable in a manner similar to that of Austrian patent No. 337,753, and pairs of crank arms connecting the upper ends of the tamping tools of each pair to a respective crank arm.

SUMMARY OF THE INVENTION

It is the primary object of this invention to improve a bassast tamping assembly for simultaneously tamping three successive ties so that a vibratory force is transmitted from the crank arm to the tamping tools in a simplified and dependable manner.

In a ballast tamping assembly of the first described type, this and other objects are accomplished according to the invention with a vertically adjustable tool carrier means, three pairs of vibratory ballast tamping tools mounted on the tool carrier means and arranged successively in the longitudinal direction of the track, each tamping tool including a tamping pick and the pairs of tamping tools being so spaced from each other in the longitudinal direction of the track that two adjacent proximal tools of the three pairs may be immersed in the ballast in each crib defined between the three successive ties and a respective distal tool may be immersed in the ballast in a respective crib adjacent each crib of these cribs, two crank shafts mounted on the tool carrier means and spaced from each other in this direction, and reciprocating drives mounted on the tool carrier means and connected to the tamping tools for reciprocating the tool in this direction, the reciprocating drives connected to the two proximal tools in each crib and the distal tool adjacent thereto connecting each crank shaft t the two proximal tools and the distal tool.

The arrangement of two crank shafts connected to the tamping tools in this specific manner provides a simplified structure for transmitting vibratory forces from the rotating crank shafts to the tamping tools. This structure is excellently adapted to withstand the very rough operating conditions to which it is subjected by the vibrations and the repeated impacts on immersion of the tamping tools into the ballast. This is due particularly to the direct support of the reciprocating drives on the crank shafts without the interposition of any transmission elements. In addition, the mechanical stress on the crank shafts is substantially halved so that the crank shafts may be dimensioned smaller which largely compensates for the additional expense of the double arrangement.

Each crank shaft is rotatable about an axis extending transversely to the longitudinal direction of the track and this axis defines a vertical plane of symmetry, and according to a preferred feature of this invention, the reciprocating drives connected to the two adjacent tools in each crib are arranged symmetrically with respect to this plane. This which are connected to the reciprocating drives, to be symmetrically arranged, which produces a uniform transmission of the reciprocating forces.

According to one embodiment of the present invention, the tool carrier means comprises two vertically adjustable tamping tool carriers arranged successively in the longitudinal direction of the track, independently operable vertical adjustment drives are connected to each tamping tool carrier, and one of the crank shafts, two of the adjacent proximal tools and a respective distal tool adjacent thereto are mounted on each tamping tool carrier. Such a partition of the tool carrier means enables the tamping tools on one of the carriers to operate upon their immersion in the ballast even if a track obstacle in the path of one of the tamping tools on the other carrier prevents it from being lowered. In other words, such a ballast tamping assembly may be used without any retrofitting for the simultaneous tamping of three successive ties or for tamping a single tie.

Preferably, the two tamping tool carriers, the cranks shafts and the tools connected thereto are arranged symmetrically with respect to a transverse vertical plane of symmetry. This will enable each tamping tool carrier to operate as an independent tamping head without an time-consuming retrofitting or centering.

In case the tamping tool carrier means is comprised of a single carrier on which each crank shaft is rotatable about an axis extending transversely to the longitudinal direction of the track and a transverse vertical center plane extending parallel to and between the crank shafts defines two halves of the tool carrier, two of the proximal tamping tools immediately adjacent the center plane in respective ones of the tool carrier halves preferably have upper ends connected to respective ones of the reciprocating drives and extend into the opposite tool carrier halves, the two upper tamping tool ends being transversely spaced from each other in the direction of the crank shaft axes. The upper tamping tool ends may be offset to provide the transverse spacing. Such an offset arrangement, in which the upper tamping tool ends overlap, enables the two proximal tamping tools immediately adjacent the center plane to be reciprocated without interfering with each other, in addition to which the resultant elongation of the upper lever arm of these tamping tools provides an improved transmission of the reciprocating forces to these tools.

Where the tool carrier is supported by at least three vertical guide posts for vertical adjustment and two vertical adjustment drives are connected to the tool carrier, the vertical adjustment of the very heavy carrier may be effected rapidly and without problems after each tamping cycle.

According to another preferred feature, each proximal tamping tool comprises a tamping pick holder and each pick comprises a shaft mounted in the holder and having a longitudinal axis, the two adjacent proximal tamping tools in each crib being reciprocable into an end position wherein the tamping pick holders and the shaft axes are arranged in a common vertical plane extending transversely to the longitudinal direction of the track. In this way, the tamping picks of the proximal tools immersed in one crib require a minimal space and the tamping tools can, therefore, be immersed in rather narrow cribs. Each crank shaft is rotatable about an axis extending transversely to this direction and the crank shaft axis preferably extends in the common vertical plane. In this way, the two proximal tamping tools impressible in the same crib are symmetrically arranged and a uniform transmission of the reciprocating forces thereto is assured.

The two adjacent proximal tamping tools may comprise a tamping pick holder and two tamping picks, each pick comprising a shaft mounted in the holder and having a longitudinal axis, the holder having a curved cross section extending perpendicular to the shaft axes, the two holders being so offset in relation to each other in a direction extending transversely to the shaft axes that they interdigitate. The interdigitating arrangement of the tamping pick holders on the one hand enables an unhindered relative movement and, on the other hand, makes it possible to fix the picks firmly in the holders.

The two crank shafts may be mechanically coupled, which assures that the two tamping tools immersed in adjacent cribs at respective longitudinal sides of each tie being tamped are always vibrated in counter-phase.

The ballast tamping assembly of this invention may be incorporated in a ballast tamping machine comprising a machine frame and an assembly carrier frame longitudinally displaceably connected to the machine frame, in which case the tool carrier frame means is vertically adjustably mounted on the assembly carrier frame and a front end of the assembly carrier frame is linked to the machine frame while a rear end thereof is supported on the track by a swivel truck. In this arrangement of the very heavy three-tie ballast tamping assembly, the weight of the assembly is concentrated on the carrier frame which is displaced cyclically from tamping site to tamping site while the larger mass on the heavy machine frame advances continuously and independently of the tamping cycles.

BRIEF DESCRIPTION OF THE DRAWING

The above and other objects, advantages and features of the invention will become more apparent from the following detailed description of certain now preferred embodiments thereof, taken in conjunction with the somewhat schematic drawing wherein.

DETAILED DESCRIPTION OF THE PREFERRED EMBODIMENTS

Figure 1:
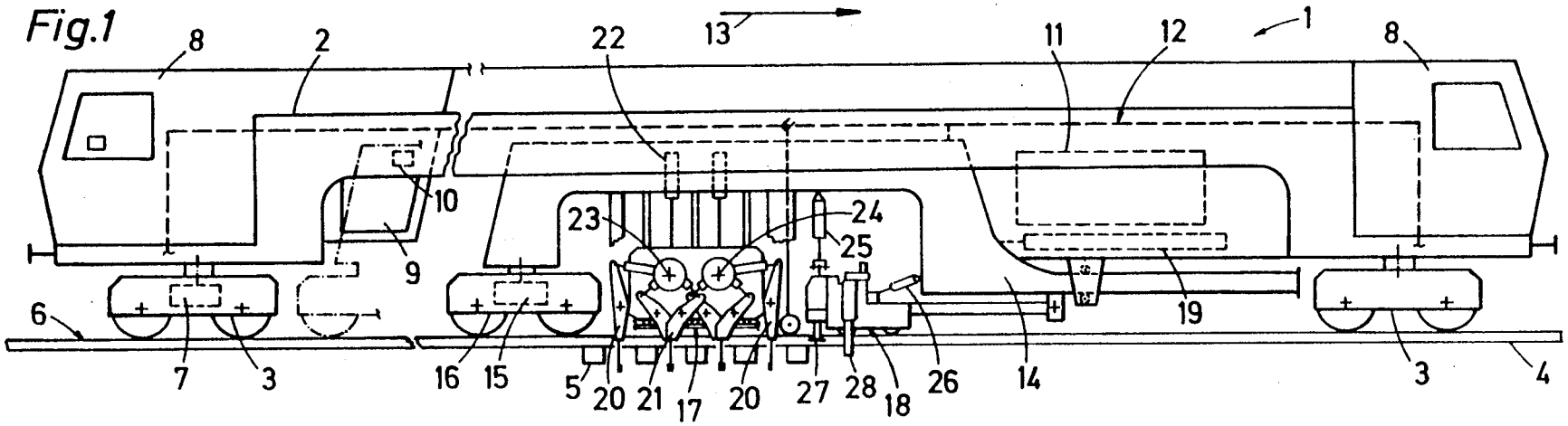
FIG. 1 shows a side elevation of a continuous action tamper with a ballast tamping assembly for simultaneously tamping three successive ties.

Referring now to the drawing and first to FIG. I, there is shown a ballast tamping machine 1 comprising elongated machine frame 2 whose ends are supported by swivel trucks 3, 3 on track 6 consisting of rails 4 fastened to successive ties 5 defining cribs therebetween. Drive 7 enables the machine frame to move continuously along the track during a tamping operation in an operating direction indicated by arrow 13. Driver's cabs 8 are mounted on the opposite ends of machine frame 2 and an operating cab 9 housing central control panel 10 is mounted on the machine frame within view of ballast tamping assembly 17. Machine frame 2 also carries central power plant 11 providing to the operating drives of the machine. In a conventional manner, the track position is controlled by leveling reference system 12. An assembly carrier frame 14 is longitudinally displaceably connected to machine frame 2 between swivel trucks 3, tamping tool carrier frame 33 is vertically adjustably mounted on assembly carrier frame 14 and a front end of the assembly carrier frame is longitudinally displaceably linked to machine frame 2 while a rear end thereof is supported on track 6 by swivel truck 16. Longitudinal displacement drive 19 is connected to assembly carrier frame 14 for cyclically displacing the same during the tamping operation while machine frame 2 advances continuously. In addition to ballast tamping assembly 17, carrier frame 14 supports track leveling and lining unit 18 connected to the carrier frame by lifting and lining drives 25, 26. Flanged lining rollers enable unit 18 to move along track 6, and the unit comprises track lifting tools including lifting hooks is and flanged lifting roller 27 pivotal into engagement with the field side of rail 4 so that the flange of the lifting roller subtends the head of the rail.

Assembly carrier frame 14 is displaceable relative to machine frame 2 by drive 19 and an independent drive 15 incorporated into swivel truck 16 between a forward end position shown in full lines and a rear end position fragmentarily shown in phantom lines. During tamping, the assembly carrier frame remains stationary while the machine frame continues to advance. After each tamping cycle, drives 15 and 19 rapidly move the assembly carrier frame into its forward end position for operating in the subsequent tamping site. The general construction and operation of such continuous action tampers are conventional.

Figure 2:
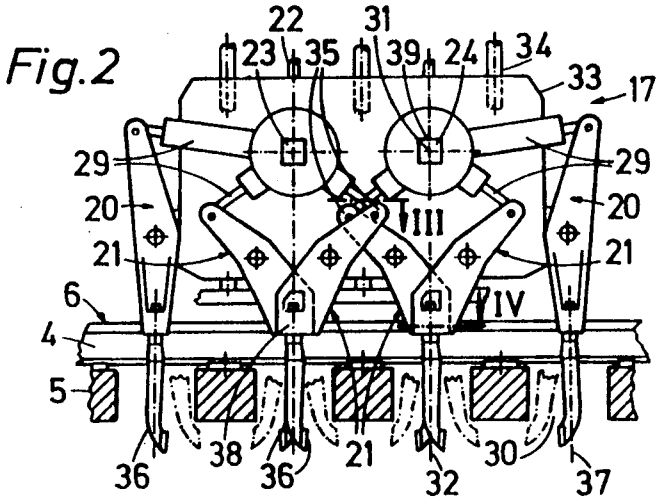
FIG. 2 is an enlarged side elevation of the ballast tamping assembly.

As will be more apparent from FIG. 2, assembly 17 is adapted for tamping ballast underneath three successive ties 5 defining cribs therebetween and comprises a vertically adjustable tool carrier means consisting in this embodiment of single tool carrier 33, three pairs of vibratory ballast tamping tools 20, 21 mounted on the tool carrier 33 and arranged successively in the longitudinal direction of track 6, each tamping tool including a tamping pick 36 and the pairs of tamping tools being so spaced from each other in this direction that two adjacent proximal tools 21 of the three pairs may be immersed in the ballast in each crib 30 defined between the three successive ties and a respective distal tool 20 may be immersed in the ballast in a respective crib 30 adjacent each of these cribs. The ballast tamping assembly further comprises two crank shafts 23, 24 arranged to impart vibrations to the tamping tools and spaced from each other in this direction on tool carrier 33, and reciprocating drives 29 mounted on the tool carrier and connected to tamping tools 20, 21 for reciprocating the tools in this direction, the reciprocating drives connected to the two proximal tools 21 in each crib and the distal tool 20 adjacent thereto connecting each crank shaft 23, 24 to the two proximal tools 21 and the distal tool 20. While the ballast tamping assembly has been shown in FIG. 1 incorporated in a continuous action tamper, it may obviously also be used on an intermittently advancing tamping machine.

Each crank shaft 23, 24 is rotatable about axis 31 extending transversely to the longitudinal direction of track 6 and this axis defines a vertical plane of symmetry 32. The shorter reciprocating drives 29 connected to the two proximal tools 21 in each crib 30 are arranged symmetrically with respect to plane 32. Three vertical guide posts 34 support tool carrier 33 for vertical adjustment and two vertical adjustment drives 22 are connected to the tool carrier.

Figure 3:
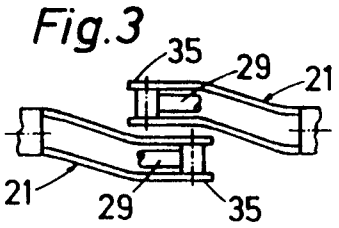
FIG. 3 is an enlarged fragmentary top view of two cooperating proximal tamping tools of the assembly, along line III of FIG. 2.

A transverse vertical center plane extending parallel to and between crank shafts 23, 24 defines two halves of tool carrier 33. Two of the proximal tamping tools 21 immediately adjacent the center plane in respective halves of tool carrier 33 have upper ends 35 connected to respective reciprocating drives 29 and extend into the opposite tool carrier halves, the two upper tamping tool ends 35 being transversely spaced from each other in the direction of crank shaft axes 31. As best shown in FIG. 3, upper tamping tool ends 35 are offset to provide the transverse spacing.

Figure 4:
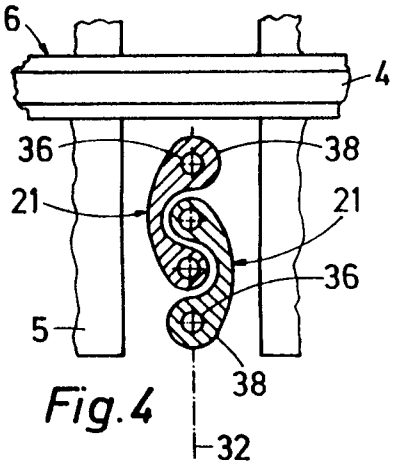
FIG. 4 is an enlarged fragmentary cross section of two proximal tamping tools impressible in the same crib, along line IV of FIG. 2.

As will be clear from a joint consideration of FIGS. 2 and 4, each one of the two proximal tamping tools 21, 21 comprises a tamping pick holder 38 and each pick 36 comprises a shaft mounted in the holder and having a longitudinal axis 37, the two proximal tamping tools in each crib 30 being reciprocable into an end position wherein tamping pick holders 38 and shaft axes 37 are arranged in common vertical plane 32 extending transversely to the longitudinal direction of the track. Crank shaft axis 31 extends in this common vertical plane.

As shown in FIG. 4, holder 38 has a curved cross section extending perpendicular to shaft axes 37 and the two holders are so offset in relation to each other in a direction extending transversely to the shaft axes that they interdigitate. The two proximal tamping tools 21 in each crib are reciprocable into an end position wherein shaft axes 37 are arranged in common vertical plane 32 with crank shaft axis 31.

The illustrated reciprocating drives 29 are hydraulic jacks and, to enable the tamping picks of each pair of tamping tools used to tamp a respective tie 5 to vibrate in counter-phase, the two crank shafts are mechanically coupled.

Figure 5:
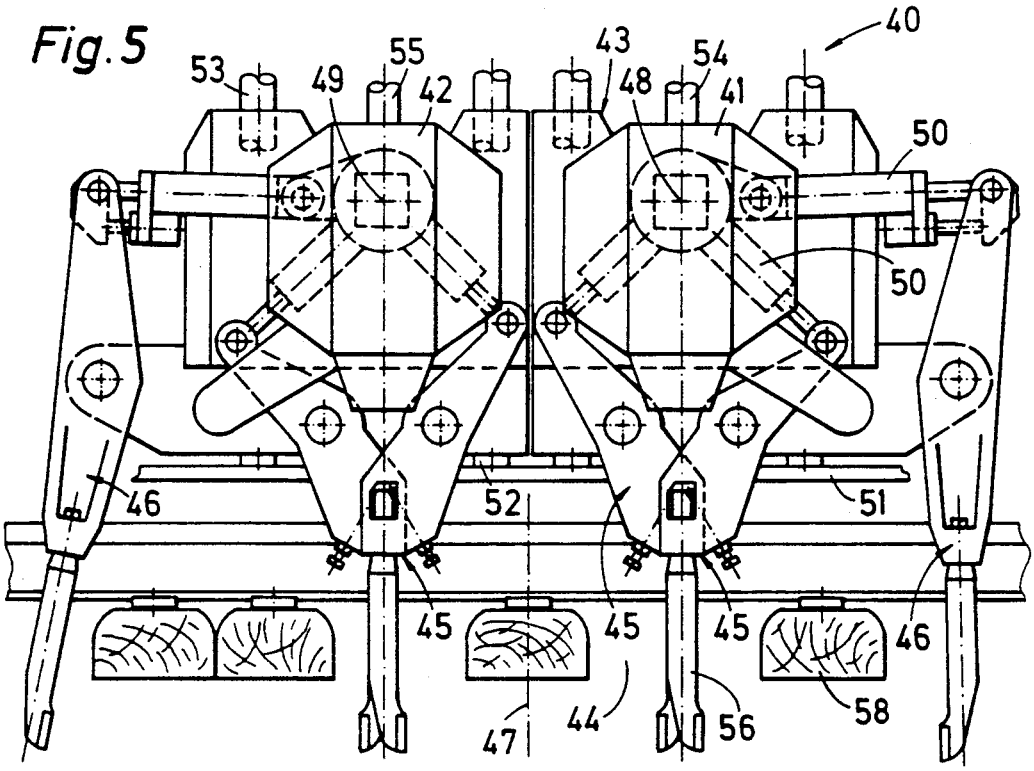
FIG. 5 is an enlarged side elevational view of another embodiment of the ballast tamping assembly.
Figure 6:
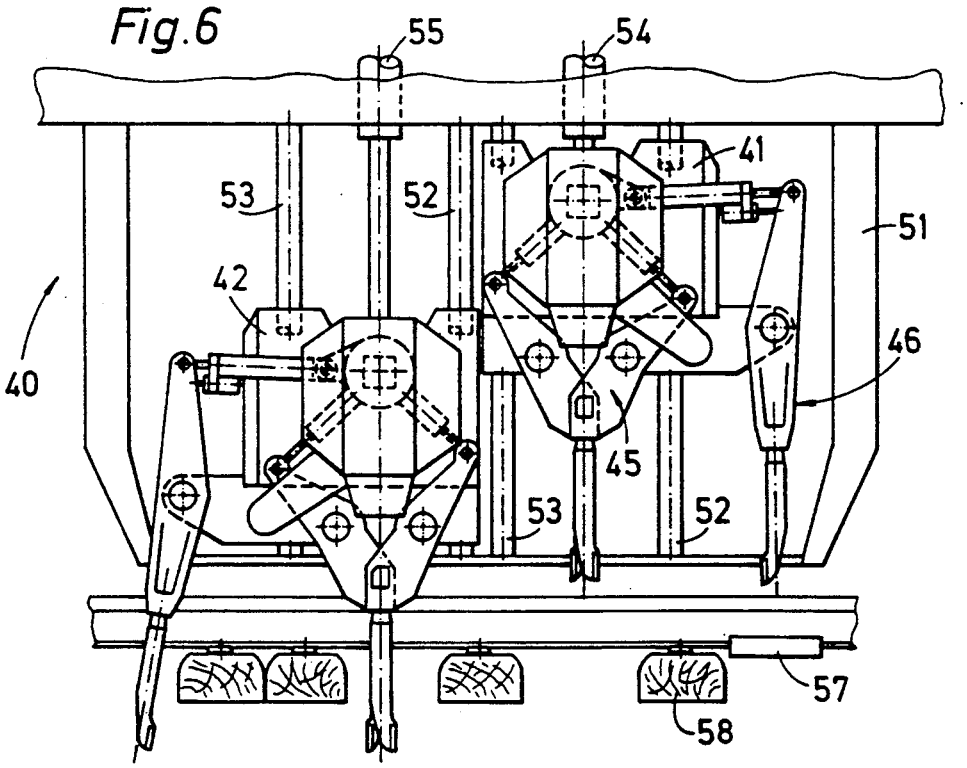
FIG. 6 is a like view of this ballast tamping assembly, with only one of its tamping tool carriers being lowered into a tamping position.

In the embodiment illustrated in FIGS. 5 and 6, tool carrier means 43 of ballast tamping assembly 40 comprises two vertically adjustable tamping tool carriers 41 and 42 arranged successively in the longitudinal direction of track 6. Independently operable vertical adjustment drives 54, 55 are connected to each tamping tool carrier 41, 42 to move the carriers along vertical supporting guide posts 52, 53, and one of the crank shafts 48, 49, two of the proximal tools 45 and a respective distal tool 46 adjacent thereto are mounted on each tamping tool carrier. The two tamping tool carriers 41, 42, the crank shafts 48, 49 and the tools 45, 46 connected thereto are arranged symmetrically with respect to a transverse vertical plane of symmetry 47.

As shown in FIG. 6, each tool carrier may be independently lowered for a tamping operation so that, for example, if a tamping tool on carrier 41 would encounter a track obstacle 57 if it were lowered into operating position for immersion in the ballast, carrier 42 may still be operated to tamp a tie 58.

What is claimed is:

1. An assembly for tamping ballast underneath three successive ties of a longitudinally extending track including two rails supported on a plurality of successive ties resting on the ballast, the three successive ties defining cribs therebetween, the ballast tamping assembly comprising (a) a vertically adjustable tool carrier means, (b) three pairs of vibratory ballast tamping tools mounted on the tool carrier means and arranged successively in the longitudinal direction of the track, each tamping tool including a tamping pick and the pairs of tamping tools being so spaced from each other in said direction that two adjacent proximal tools of the three pairs may be immersed in the ballast in each crib defined between the three successive ties and a respective distal tool may be immersed in the ballast in a respective crib adjacent each of said cribs, (c) two crank shafts mounted on the tool carrier means and spaced from each other in said direction, and (d) reciprocating drives mounted on the tool carrier means and connected to the two proximal tools in each crib and the distal tool adjacent thereto for reciprocating the tools in said direction, the reciprocating drives connecting each crank shaft to the two proximal tools and the distal tool, each crank shaft being rotatable about an axis extending transversely to said direction and said axis defining a vertical plane of symmetry, the reciprocating drives connected to the two proximal tools in each crib being arranged symmetrically with respect to said plane.

2. The ballast tamping assembly of claim 1, wherein the tool carrier means comprises two vertically adjustable tamping tool carriers arranged successively in said direction, further comprising independently operable vertical adjustment drives connected to each tamping tool carrier, one of the crank shafts, two of the proximal tools and a respective one of the distal tools adjacent thereto being mounted on each tamping tool carrier.

3. The ballast tamping assembly of claim 2, wherein the two tamping tool carriers, the cranks shafts and the tools connected thereto are arranged symmetrically with respect to a transverse vertical plane of symmetry.

4. The ballast tamping assembly of claim 1, wherein each crank shaft is rotatable about an axis extending transversely to said direction and a transverse vertical center plane extending parallel to and between the crank shafts defines two halves of the tool carrier means, two of the proximal tamping tools immediately adjacent the center plane in respective ones of the tool carrier means halves having upper ends connected to respective ones of the reciprocating drives and extending into the opposite tool carrier means halves, the two upper tamping tool ends being transversely spaced from each other in the direction of the crank shaft axes.

5. The ballast tamping assembly of claim 1, wherein the tool carrier means is comprised of a tool carrier, at least three vertical guide posts support the tool carrier for vertical adjustment and two vertical adjustment drives are connected to the tool carrier.

6. The ballast tamping assembly of claim 1, wherein each one of the two proximal tamping tools comprises a tamping pick holder and each pick comprises a shaft mounted in the holder and having a longitudinal axis, the two proximal tamping tools in each crib being reciprocable into an end position wherein the tamping pick holders and the shaft axes are arranged in a common vertical plane extending transversely to said longitudinal direction.

7. The ballast tamping assembly of claim 6, wherein each crank shaft is rotatable about an axis extending transversely to said direction and the crank shaft axis extends in said common vertical plane.

8. The ballast tamping assembly of claim 1, wherein each one of the two proximal tamping tools comprises a tamping pick holder and two of said tamping picks, each pick comprising a shaft mounted in the holder and having a longitudinal axis, the holder having a curved cross section extending perpendicular to the shaft axes, the two holders being so offset in relation to each other in a direction extending transversely to the shaft axes that they interdigitate.

9. The ballast tamping assembly of claim 8, wherein each crank shaft is rotatable about an axis extending transversely to said direction, the two proximal tamping tools in each crib being reciprocable into an end position wherein the shaft axes are arranged in a common vertical plane with the crank shaft axis.

10. The ballast tamping assembly of claim 1 and incorporated in a ballast tamping machine, further comprising a machine frame and an assembly carrier frame longitudinally displaceably connected to the machine frame, the tool carrier a means being vertically adjustably mounted on the assembly carrier frame and a front end of the assembly carrier frame being linked to the machine frame while a rear end thereof is supported on the track by a swivel truck.

* * * * *